US009154882B2

(12) United States Patent
Berkhoff

(10) Patent No.: US 9,154,882 B2
(45) Date of Patent: Oct. 6, 2015

(54) SOUND GENERATOR

(75) Inventor: Arthur Perry Berkhoff, Doetinchem (NL)

(73) Assignee: NEDERLANDSE ORGANISATIE VOOR TOEGEPAST-NATUURWETENSCHAPPELIJK ONDERZOEK TNO, Delft (NL)

( * ) Notice: Subject to any disclaimer, the term of this patent is extended or adjusted under 35 U.S.C. 154(b) by 460 days.

(21) Appl. No.: 12/598,006

(22) PCT Filed: Apr. 29, 2008

(86) PCT No.: PCT/NL2008/050266
§ 371 (c)(1),
(2), (4) Date: Dec. 16, 2009

(87) PCT Pub. No.: WO2008/136668
PCT Pub. Date: Nov. 13, 2008

(65) Prior Publication Data

US 2010/0111351 A1 May 6, 2010

(30) Foreign Application Priority Data

May 3, 2007 (EP) ..... 07107454

(51) Int. Cl.
*H04R 25/00* (2006.01)
*H04R 7/04* (2006.01)
(Continued)

(52) U.S. Cl.
CPC ..... *H04R 7/045* (2013.01); *H04R 1/24* (2013.01); *H04R 7/10* (2013.01)

(58) Field of Classification Search
CPC .. H04R 17/00; H04R 7/045; H04R 2307/029; H04R 1/025; H04R 1/028; H04R 2499/15; H04R 5/02; H04R 5/023; H04R 7/04; H04R 7/06; H04R 7/10; H04R 1/24; H04R 1/2834; H04R 2201/021; H04R 2499/11; H04R 2499/13
USPC ..... 381/152, 190, 191, 431
See application file for complete search history.

(56) References Cited

U.S. PATENT DOCUMENTS 4,322,583 A 3/1982 Maeda
4,461,930 A * 7/1984 Melillo et al. ..... 381/190
(Continued)

FOREIGN PATENT DOCUMENTS

EP 0 147 992 A2 7/1985
JP 59 083497 A 5/1984
(Continued)

OTHER PUBLICATIONS

International Search Report PCT/NL2008/050266 dated Jul. 8, 2008.
(Continued)

*Primary Examiner* — Davetta W Goins
*Assistant Examiner* — Phylesha Dabney
(74) *Attorney, Agent, or Firm* — Leydig, Voit & Mayer, Ltd.

(57) ABSTRACT

A sound generator, particularly a loudspeaker, configured to emit sound, comprising a rigid element (2) enclosing a plurality of air compartments (3), wherein the rigid element (2) has a back side (B) comprising apertures (4), and a front side (F) that is closed, wherein the generator is provided with at least one actuator (6), for instance one or more electromagnetic actuators and/or piezoelectric elements, configured to actuate the rigid element (2) for the generation of the sound.

24 Claims, 7 Drawing Sheets

(51) Int. Cl.
*H04R 1/24* (2006.01)
*H04R 7/10* (2006.01)

(56) References Cited

U.S. PATENT DOCUMENTS

| | | | | |
|---|---|---|---|---|
| 4,751,419 | A | 6/1988 | Takahata | |
| 6,377,695 | B1 * | 4/2002 | Azima et al. | 381/152 |
| 6,481,173 | B1 | 11/2002 | Roy et al. | |
| 7,088,836 | B1 * | 8/2006 | Bachmann et al. | 381/152 |
| 7,194,098 | B2 * | 3/2007 | Azima et al. | 381/152 |
| 8,103,024 | B2 * | 1/2012 | Bachmann et al. | 381/152 |

FOREIGN PATENT DOCUMENTS

| | | | |
|---|---|---|---|
| WO | WO 02/23946 | A2 | 3/2002 |
| WO | WO 02/078391 | A2 | 10/2002 |

OTHER PUBLICATIONS

Communication from European Patent Office identifying References.

* cited by examiner

SOUND GENERATOR

FIELD OF THE INVENTION

The invention relates to a sound generator, particularly a loudspeaker, configured to emit sound.

BACKGROUND

Loudspeakers are known in many different variants. A conventional type of loudspeaker is the piston type loudspeaker, having a vibrating cone to drive the air, so that a beam of sound can be generated. In many applications, the conventional loudspeaker comprises a relatively large cabinet extending behind the vibrating cone, to prevent that backwardly radiating sound can enter the same space as an emitted beam of sound.

Another type of loudspeaker is the so called "flat panel" speaker, see for example U.S. Pat. No. 6,481,173 B1. The known flat panel speaker comprises a radiating panel, and an exciter hooked up to the panel to cause the panel to vibrate. Use is made of a complex random ripple of wave forms on the panel surface, leading to an omni-directional sound generation. Compared to piston-like movement of the conventional cone-type loudspeaker, the motion of the flat panel speaker is determined by many different modes spread over the radiator surface, possibly leading to incoherent sound radiation. A common disadvantage of known flat panel speaker systems is that they are not good in producing low frequency sound.

U.S. Pat. No. 4,322,583 discloses a prior art honeycombed core structure of a flat plate electroacoustic transducer.

JP59083497 relates to a diaphragm for a speaker, which is lightweight and highly rigid. JP'497 aims to improve disadvantages of known honeycomb-type core diaphragms, and provides a sheet which has a large number of hollow protrusions, uniform and concentric with the centre of diaphragm.

Particularly, according to the description of JP'497, FIG. 1 of JP'497 is a plan view which is partially cut away of the surface material of the speaker diaphragm presented in an exemplary embodiment of the present invention, and FIG. 2 of JP'497 is a view in cross section. In these figures, (1) is a surface material, and (3) is a metal or plastic sheet which comprises hollow cylindrical protrusions (2); said protrusions (2) are concentric with respect to the centre of the diaphragm and arranged uniformly in the circumferential direction, and they are integral with the sheet (3). Furthermore, the bottom surfaces of the protrusions (2) are throughholes. According to JP'497, the surface material (1) is adhered to the tip end surface of the cylindrical protrusions (2) of the abovementioned sheet (3) by means of a polyamide-based or EOA-based adhesive. The surface material (1) can be a metal or plastic sheet.

Moreover, JP'497 provides a description of a production method, in which the sheet (3) comprising the protrusions (2) is moulded using a moulding method such as vacuum forming, extrusion moulding or press moulding to mould the metal or plastic sheet described above, after which the tip end side of the protrusions (2) is slightly cut to open the protrusions (2). After this, the sheet-like surface material (1) is adhered to the tip end surface of the protrusions (2) by means of adhesive, whereby it is possible to produce the diaphragm.

Moreover, according to JP'497, the end surfaces of the protrusions (2) can be open or closed. In the latter case, the step of cutting the end surfaces can be dispensed with, and this has an effect whereby the step of adhering the protrusions (2) to the surface material (1) becomes simpler.

SUMMARY OF THE INVENTION

The present invention aims to provide an improved sound generator. Particularly, the invention aims to provide an efficient, preferably compact, sound generator that can provide sound in a relatively large frequency range, particularly at or including relatively low frequencies.

According to an embodiment of the invention, this is achieved by the features of claim 1.

Advantageously, a sound generator, particularly a loudspeaker, comprises a rigid element enclosing a plurality of air compartments, wherein the rigid element has a back side comprising apertures, and a front side that is closed, wherein the generator is provided with at least one actuator, for instance one or more electromagnetic actuators and/or piezoelectric elements, configured to actuate the rigid element for the generation of the sound.

In this way, an improved, relatively efficient sound generator can be provided, that can be made relatively compact and that can provide sound in a relatively large frequency range. Particularly, the present sound generator can be used to produce both low frequency sound (for example in the frequency range below about 100 Hz) and medium and high frequency sound (for example above about 100 Hz).

Moreover, since the rigid element has a back side comprising apertures, a space that is enclosed by the rigid elements (i.e. a cumulative internal space of all the air compartments that are provided in the rigid element) can preferably be available as an acoustic load in order to improve efficiency, that can preferably provide a substantially linear air spring. In a non-limiting embodiment, the sound generator can be designed to generate directional sound, contrary to above-described omni-directional flat panel type systems. For example, according to an embodiment, the sound generator can be designed to provide piston-type of actuation of the rigid element.

According to a further embodiment, the apertures of said back side of the rigid element are in air connection (i.e. fluid communication) with an air space extending at least behind the rigid element, particularly such that air in that air space can communicate directly with air in the air compartments of the rigid elements.

In an embodiment, the sound generator can be used in an infinite-baffle type configuration.

Preferably, the sound generator can comprise an internal air chamber extending at least behind the back side of the rigid element, the apertures of said back side being in air connection with that internal air chamber. For example, the volume of the internal air chamber can be smaller than an overall internal volume of the rigid element, so that a relatively compact sound generator can be provided, comprising relatively large air compartments in the rigid element. For example, the rigid element can be made relatively thick compared to a thickness of the mentioned air chamber. For example, there can be provided a housing or cabinet enclosing the mentioned air chamber and being provided with the rigid element.

Good results can be obtained in case the apertures are arranged to provide air connections to all of the air compartments of the rigid element.

According to a further embodiment, the sound generator comprises a, preferably flexible or resilient, support structure to hold the rigid element, such that the rigid element can be actuated with respect to the support structure to generate the sound.

A relatively compact arrangement can be provided when the at least one actuator at least partly extends in the rigid element.

The rigid element can be constructed in various ways and of various materials. For example, the rigid element can be made of metal, plastic, paper, glass, an alloy, wood, a composite material, reinforced material, for example carbon fiber or glass fiber reinforced material, and/or a combination thereof.

Preferably, the rigid element has a sandwich structure. For example, the rigid element can be constructed from a rigid, solid (i.e., not interrupted, continuous) front plate or sheet, providing the closed front surface thereof, and a rigid core material that can provide the air compartments. A back side of the core can provide a mentioned back side of the rigid element. Alternatively, a core comprising the air compartments can be provided with a perforated back plate or sheet, to further improve rigidity of the rigid element. Various parts or layers of the rigid element can be made of the same material(s), however, this is not necessary.

Also, according to an embodiment, good rigidity can be provided in the case that the rigid element has a honeycomb cell structure. For example, a core part of the rigid element can be a core consisting of honeycomb cells (the cells having honeycomb cross-sections when viewed in longitudinal panel cross-section, perpendicular to a direction of sound emission).

The front and back side of the rigid element are preferably substantially parallel. Also, the rigid element can be substantially flat, having a thickness that is significantly smaller than longitudinal dimensions of the element. The rigid element can have various forms and shapes, for example having a substantially flat, even shape, or being curved, convex, concave, cone or dome shaped, or formed differently if desired.

Besides, an other aspect of the patent application provides a sound generator, particularly a loudspeaker, configured to emit sound, comprising a rigid element having a front side that is closed, wherein the generator is provided with at least one actuator, for instance one or more electromagnetic actuators and/or piezoelectric elements, configured to actuate the rigid element for the generation of the sound, wherein the rigid element further comprises one or more piezo-electric elements that can be actuated to adjust frequency response characteristics of the rigid element.

BRIEF DESCRIPTION OF THE DRAWINGS

Further elaborations of the invention are described in the subclaims. The invention will now be elucidated on the basis of exemplary embodiments and with reference to the drawing, in which:

DETAILED DESCRIPTION OF THE DRAWINGS

Similar or corresponding features are denoted by similar or corresponding reference signs in the present patent application.

Figure 1:
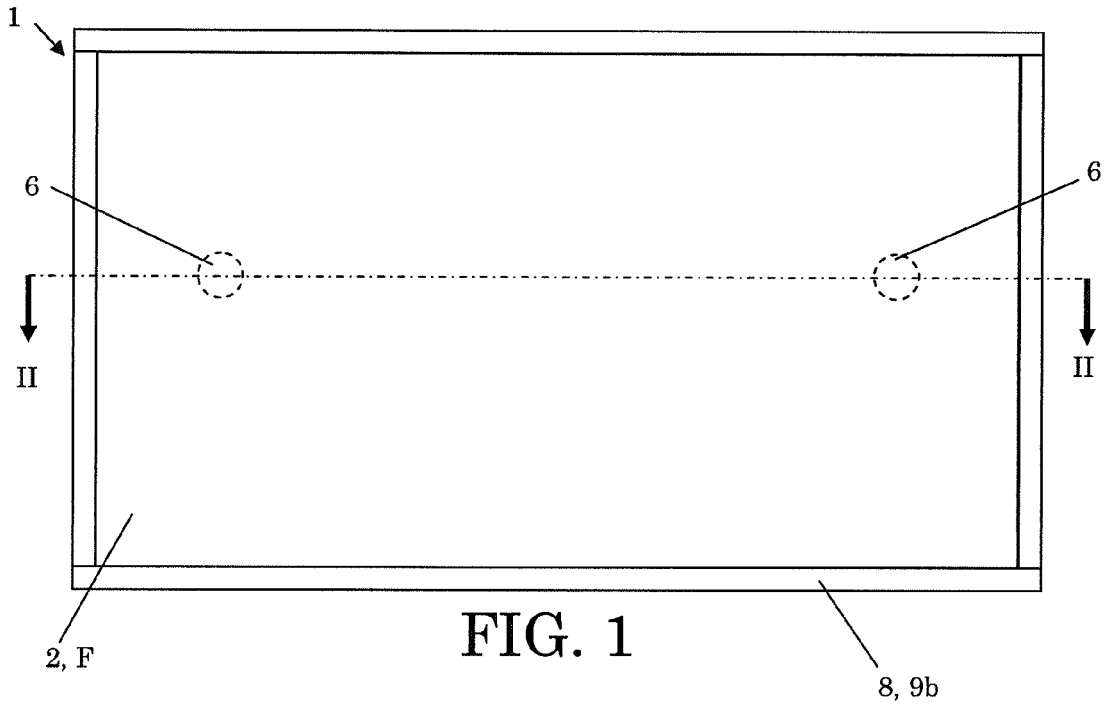
FIG. 1 shows a front view of an exemplary first embodiment of the invention.
Figure 2:
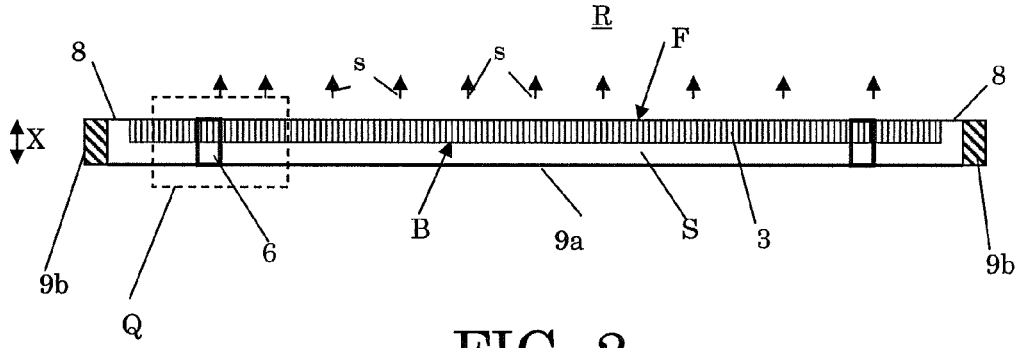
FIG. 2 shows a transversal cross-section over line II-II of the front view shown in FIG. 1.
Figure 3:
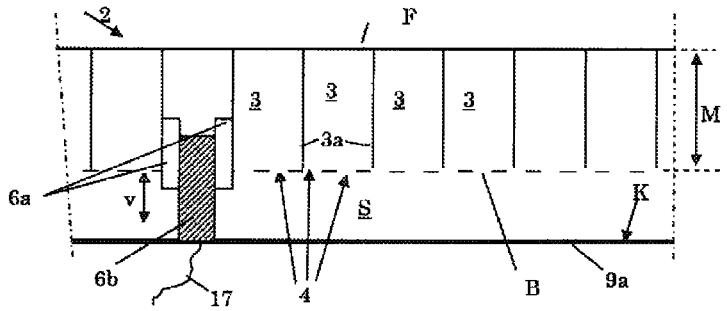
FIG. 3 shows a detail Q of FIG. 2.

FIGS. 1-3 show a first embodiment of a sound generator 1, for example a loudspeaker, configured to emit sound. The sound generator 1 can be used in many different applications, for example to reproduce music, to generate anti-sound that is to cancel or reduce external noise of other sound sources, and other applications.

Preferably, the sound generator 1 is provided with a rigid, stiff element 2. For example, the rigid element 2 can be a panel or plate, and can have various shapes and dimensions. In the present embodiment, a panel shaped rigid element 2 is provided, having a rectangular front face F, however, other shapes can also be implemented, for example an element having a triangular, square, circular, elliptical, polygonal curved or and/or differently shaped front side.

The rigid element 2 comprises a large number of internal hollow air compartments or cells 3. In the present embodiment, the rigid element 2 is provided with a rigid internal wall structure 3*a* defining the air compartments 3. Preferably, such internal walls 3*a* extend substantially transversally through the rigid element 2, from a front side F to a back side B, as in the present embodiment. For example, the internal air compartments 3 can be distributed homogeneously along the rigid element 2, viewed in longitudinal directions, and the internal air compartment walls 3*a* can be spaced-apart from each other at substantially equal distances (in longitudinal directions). However, the rigid element 2 can also comprise inhomogeneously distributed internal air compartments.

In the present embodiment, the rigid element 2 has a longitudinal back side B comprising apertures 4, and a longitudinal front side F that is closed (i.e., the front side F as such does not comprise any apertures). Preferably, the back side B has the same outer contour (for example rectangular, or a different contour) as the front side F. Sound that can be emitted by the sound generator is schematically indicated by arrows s in FIG. 2. Particularly, the sound generator 1 is designed to emit the sound s in a direction that is substantially away from the front side F, towards a space R (for example a listening room, or sound cancellation area) extending in front of the front side F.

As is described above, the rigid element 2 can have a sandwich structure. For example, various layers or parts F, B, 3*a* of the sandwich structure can be integrally connected to or joined to each other, for example using suitable adhesive means, glue, and/or other joining means. Preferably, the rigid element 2 has a honeycomb cell structure providing air cells 3 with honeycomb cross-sections, however, the internal air compartments 3 can also be provided using a different internal structure, for example cells 3 having circular cross-sections, rectangular or square cross-sections and/or differently shaped cells 3.

According to an embodiment, a thickness M (see FIG. 3) of each air compartment 3 of the rigid element 2, measured from the front side F to the back side B, is larger than approximately 1 mm, for example in the range of about 1-50 mm. For example, the thickness M of each air compartment 3 can be larger than 1 cm, if desired, particularly to provide a relatively large active internal air volume of the element 2, and, at the same time, a relatively large stiffness of the rigid element 2. Similarly, the thickness of the rigid element 2 as such can be about the same or slightly larger than that of the air compartments 3, depending for example on the thicknesses of the front and back sides F, B. According to a further embodiment, the front side F of the rigid element 2 is a relatively rigid thin plate or layer, having a preferred thickness smaller than 1 mm, for example 0.5 mm or smaller. Similarly, the back side B of the rigid element 2 can be a thin plate or layer, having a preferred thickness smaller than 1 mm, for example 0.5 mm or smaller.

Besides, in the present embodiment, the front and back side of the rigid element 2 are substantially parallel, which can provide good results. As follows from the drawing, the rigid element 2 can be substantially flat, having a maximum thickness that is significantly smaller than longitudinal dimensions of the element 2, as in the drawing. By providing a rigid, very stiff element 2, a cutoff frequency of the sound generator can be relatively high, to provide a large frequency operating range.

The generator 1 is provided with at least one actuator 6, configured to actuate (vibrate) the stiff element 2 to generate the sound. Particularly, the one or more actuators 6 (two, in the embodiment of FIGS. 1-3) are configured to drive the element 2 to perform a piston type of movement during operation, in transversal directions X with respect to the front and back sides F, B. The actuators 6 can have various configurations, as will be appreciated by the skilled person, and—according to a further embodiment—can be driven by suitable driving signals that can be applied to the actuators 6 via suitable wiring 17. For example, the actuators 6 can include electromagnetic actuators (for example comprising electromagnetic drivers), piezoelectric elements 6 (see also the embodiments of FIGS. 9-15) and/or other actuators, see FIGS. 3-4.

In FIG. 3, each actuator comprises a first part 6*a* and a second part 6*b*, which parts 6*a*, 6*b* can move with respect to each other by electromagnetic interaction (such movement is schematically indicated by arrow v in FIG. 3). For example, one of the actuator parts can be an electromagnet, and the other actuator part can be made of magnetic material (for example in case the actuator part is or comprises a permanent magnet), as will be appreciated by the skilled person. Also, one of the actuator parts 6*a* is attached to the moveable rigid panel 2, and the other part 6*b* to a stationary construction or element 9. For example, an actuator part 6*a* can extend at least partly in the rigid element 2. Advantageously in view of manufacturability, the actuator part 6*a* extends or reaches in an air compartment of the rigid element 2, and can be attached to an interior wall of that compartment. For example, at least part 6*a* of the actuator can be integrally connected to or joined with the rigid element, for example using suitable adhesive means, glue, and/or other attachment means. Besides, in an embodiment, at least part 6*a* of the actuator can be made in one piece with the rigid element 2. As an example only, the rigid element 2 can be made of magnetic material that can be actuated using one or more electromagnet actuator parts.

Figure 4:
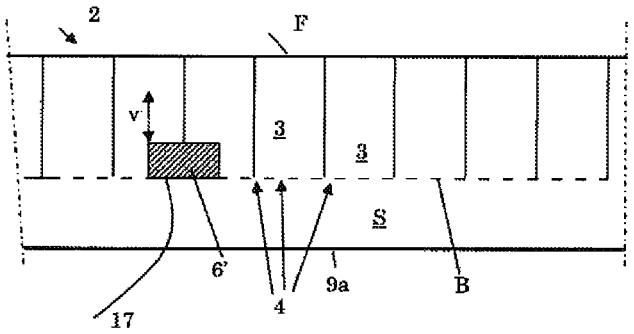
FIG. 4 shows a similar detail as FIG. 3, of an alternative embodiment.

FIG. 4 shows an alternative embodiment, wherein the rigid element 2 is provided with the one or more actuators 6'. In this case, for example, each actuator 6' can be a piezoelectric element, wherein vibrations v of the piezoelement can cause a desired actuation of the rigid element 2 to produce the sound s.

There can be provided a support structure 8 to hold the rigid element 2, such that the rigid element 2 can be actuated with respect to the sound receiving space R to generate the sound. The support structure can be provided by a guiding mechanism to guide the rigid element 2. Also, the support structure can be a flexible or resilient support structure 8, which can be configured in various ways, for example comprising flexible means, for instance spring means and/or elastic material. Such a flexible support 8 can counteract the actuated movement of the rigid element 2 using resiliency or spring forces, to move the rigid element 2 towards a non-actuated initial position. Thus, the rigid, stiff element 2 has a certain freedom of movement with respect to stationary parts 9, 9' of the sound generator. Preferably, the support structure 8 is configured to allow an above-mentioned piston type movement, in the transversal direction X. Besides, the support structure 8 can be configured to provide a seal around the rigid element, for example to provide an air-tight sealing to a holding structure 9, 9'.

Preferably, an air space S, S' extending behind the back surface B of the actuated element 2 is not in (direct) fluid communication with the front space R that is to receive the sound s. For example, the closed front part F of the rigid element 2 can provide a fluid-tight separation between the sound receiving area R and the rear or posterior space S, S'. In the present embodiment, the apertures 4 of the back side of the rigid element 2 are arranged to provide air connections from the rear space S, S' to substantially all of the air compartments 6 of the rigid element 2.

According to an embodiment, the mentioned rear space can be an internal air chamber S that extends at least behind the back side B of the rigid element 2 (i.e., the back side B extends between that rear space and the internal air compartments 3), such as in FIGS. 1-4. All apertures 4 of said back side B are preferably in air connection with that internal air chamber S, such that air can freely move between the rear air chamber S and air compartments 3 via those apertures 4. As is mentioned above, the volume of the internal air chamber S can be smaller than an overall internal volume of the rigid element 2, which is a preferred embodiment of the invention in view of device compactness and device efficiency. For example, according to a preferred embodiment, the volume of the internal air chamber S is smaller than 50% of an overall internal volume (i.e. the cumulative volume of all air cells 3) of the rigid element 2, more preferably smaller than 25% of the overall internal volume of the rigid element 2. For example, the volume of the internal air chamber S can be in the range of about 5-20%, for example about 10%, of an overall internal volume of the sound generator 1 (which total internal volume consists of the volume of that internal air chamber S plus the cumulative volume of all air cells 3 of the element 2).

Besides, preferably, the sound generator 1 comprises a rigid housing or cabinet 9, functioning as a holder to hold the rigid element 2, for example via the mentioned support means 8. The housing 9 can be configured in various ways and can be made of various materials.

The housing can be integrally provided with the flexible support structure 8. In the non-limiting FIG. 1-4 embodiments, the housing or cabinet 9 is relatively flat, and provides a rigid back part 9*a* extending opposite the back side B of the rigid element 2, spaced-apart from the rigid element. A front face K of the rigid back part 9*a* and the back side B of the rigid element preferably extend in parallel with one another. A rigid side wall 9*b* of the housing can be provided, protruding upwardly from the back part 9*a* and including the support structure 8 to hold the rigid panel 2. The height of the side wall 9*b* is preferably relatively small, for example about twice the thickness M of the rigid element 2 or smaller. Also, the housing (cabinet) 9 is preferably configured to enclose the above-mentioned internal air space with the rigid element 2, and support structure 8 in the present embodiment. Preferably, the longitudinal dimensions of the back part 9*a* (measured in the directions orthogonal with respect of a element movement directions X) of the housing are substantially the same as or only slightly larger than the dimensions of the rigid element 2.

During operation of the embodiments shown in FIGS. 1-4, the rigid element 2 can be actuated by the respective actuators 6, 6', using suitable electric signals, to emit the sound s into the sound receiving space R. As a result of the above-described configuration, the rigid element can perform a substantially piston-like movement as a result of the actuation (in above-mentioned transversal directions X). The rigid air-compartment-enclosing type of construction of the rigid element 2 (which is preferably a sandwich structure, as mentioned above) can suppress undesired random wave form ripples on the front part F thereof, and the motion of the front part F can be substantially coherent. Besides, the air compartments of the rigid element 2 can significantly boost acoustic efficiency in communicating with the enclosed air space S extending there-behind within the housing of the sound generator 1. For example, these air compartments and the remaining enclosed space S can communicate to provide a compound air spring, consisting of both the air within the rigid element 2 as air extending in the enclosed air space S. Thus, a relatively flat sound generator can be provided, having an actuated rigid element 2 wherein the cell structure of the element can both provide a desired enhanced rigidity as well as improved acoustic efficiency.

Figure 5:
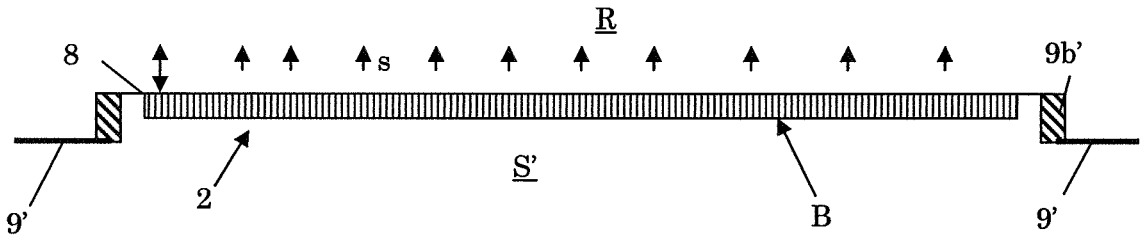
FIG. 5 shows cross-section similar to FIG. 2, of an exemplary second embodiment of the invention.

FIG. 5 shows a further embodiment, where a sound generator comprising a rigid element 2 (as described above) is mounted in an aperture in a wall 9' that separates the sound receiving area R from an area S' extending behind the back face B (i.e. to provide a so called infinite baffle configuration, as in FIG. 5). Again, one or more actuators are provided (not shown in FIG. 5) to actuate the element 2 to emit the sound s. The operation of the FIG. 5 embodiment is substantially the same as the operation of the FIG. 1-4 embodiments. For example, the wall 9 can comprise above-mentioned support structure 8' and/or holding means **9*b*' for supporting and/or holding the rigid element 2. In this case, the air compartments of the rigid element 2** can communicate with the air space S' extending there-behind, to provide improved device efficiency.

To further improve the sound generator 1, a further embodiment of the invention (see FIG. 6) provides for the application of one or more detectors 15 to detect a position or orientation of the rigid element, and preferably comprising means to counteract undesired displacements or misalignments of the rigid element 2. The mentioned detectors 15 can be configured in various ways, and may include one or more of: optical detectors, strain sensors, electrical sensors, alignment detectors, acceleration detectors, positioning means and/or other sensor types. A mentioned undesired displacement or misalignment can be detected using results provided by such detectors 15, and can be an undesired tilting (over an angle $\alpha$) as has been schematically indicated in FIG. 6, and/or undesired rotation(s) in other directions. A means to counteract a detected undesired displacement or misalignment can simply comprise one or more of the above-mentioned actuators 6. For example, there can be provided a suitable controller or signal processor, that is configured to control the actuators 6 to actuate the rigid element 2 to emit sound s using a first actuation signal, and additionally to actuate the rigid element 2 to counteract an undesired movement (such as the tilting) using an additional second actuation signal (for example being modulated onto the first signal).

Figure 6:
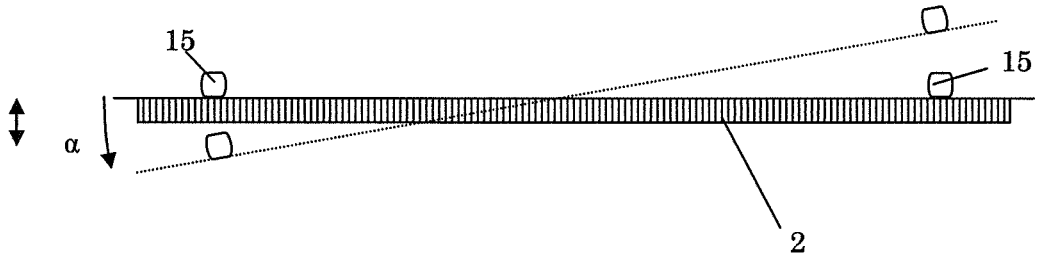
FIG. 6 schematically shows an undesired tilting of an embodiment.
Figure 7:
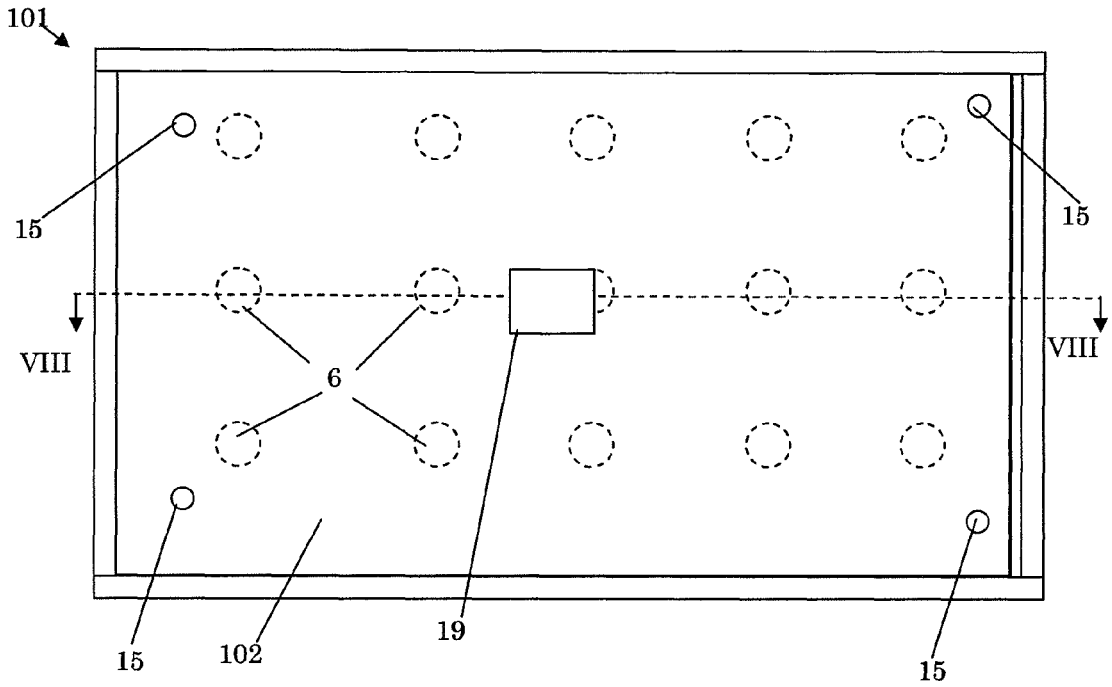
FIG. 7 shows a front view of a further embodiment.
Figure 8:
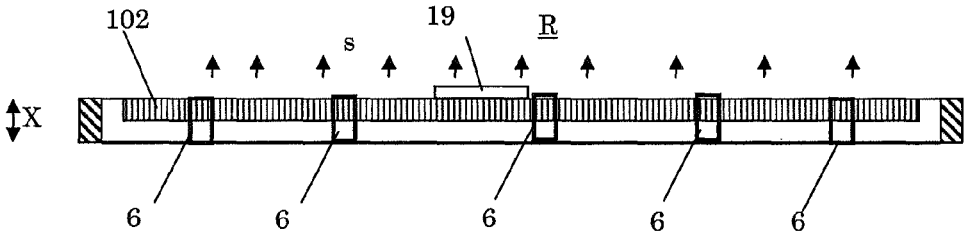
FIG. 8 is a cross-section over line XIII-XIII of FIG. 7.

FIGS. 7-8 depict a further embodiment 101 of the invention, which differs from the embodiments shown in FIGS. 1-6 that it comprises a relatively large number of actuators 6 (more than 2, for example at least 4) that are provided at various locations of the rigid element 102. Also, a number of detectors 15 are provided (for example being integrated within the element 2, or being arranged differently) to detect the position or orientation of the rigid element 102 (particularly with respect to an initial, non-actuated position).

Also, according to an embodiment, a sound generator can comprise one or more frequency response adjusters 19 to adjust frequency response characteristics of the rigid element 102. A non-limiting example of a frequency response adjuster 19 is shown in FIG. 7-8, and can comprise a piezo-electric element that is fixed to the front part F of a rigid element 102 and that can be controlled by a frequency response adjusting signal provider. For example, the frequency response adjusters 19 can be controlled to provide a substantially flat frequency response over a relatively large frequency operating range. For example, the frequency response adjusters 19 can be integrated within the rigid element 102, or be located on top of the front surface F (as in FIG. 8). A preferred location of such a frequency response adjuster 19 is at a position of relatively high strain (in the rigid element) for the vibration mode shape of interest. For example, in case of a $1^{st}$ mode and a symmetric geometry (as in the present embodiment), the adjuster is preferably located at the centre of the rigid element 102.

A sound detector and/or calibration means (not shown) can be provided to calibrate the operation of the frequency response adjuster 15, to provide a desired frequency response. For example, in this case, preferably, the rigid element 102 can be provided with air compartments 3 as in the embodiments described above, however, this is not necessary. Thus, advantageously, there can be provided a sound generator, particularly a loudspeaker, configured to emit sound, comprising a rigid element 102 having a front side F that is closed, wherein the generator is provided with at least one actuator 6, for instance one or more electromagnetic actuators and/or piezoelectric elements, configured to actuate the rigid element 102 for the generation of the sound, wherein the rigid element 102 further comprises one or more piezo-electric elements 19 that can be actuated to adjust frequency response characteristics of the rigid element 102.

Figure 9:
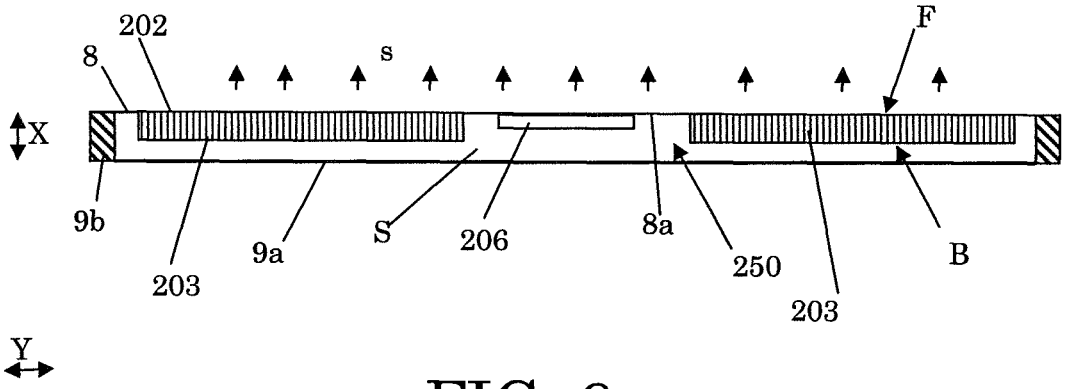
FIGS. 9-15 depict further advantageous embodiments of the invention.

FIG. 9 shows a further embodiment, which differs from the above-described embodiments, that the actuator does not comprise the first part **6*a* and a second part 6*b*, which parts 6*a*, 6*b* can move with respect to each other, the second part 6*b* being connected to the (stationary) back part 9*a***.

In the FIG. 6 embodiment, a piezoelectric actuator 206 is provided at the front side of the sound generator, to actuate the rigid element 202 for the generation of the sound s. The actuator 206 is not connected to a rigid back side **9*a* of the system. In this case, the actuator 206 ("patch actuator 206**") is the primary means for generating the sound; it can also operate to provide frequency response adjustment, at the same time.

In the FIG. 9 embodiment, the actuator 206 is coupled to the rigid element 202 via a respective coupling structure **8*a*. In the present embodiment, this coupling structure 8*a* is part of a front side of the sound generator. Preferably, the coupling structure 8*a* is a flexible coupling structure, for example a sheet or plate member made of flexible or resilient material. The structure 8*a* can be a solid (i.e., not interrupted, continuous) front plate or sheet. For example, a thickness of the flexible coupling structure 8*a***, measured in the X-direction, can be smaller than 1 mm.

For example, the coupling structure **8*a* can be made of the same material as a flexible support structure 8 that holds the rigid element 202. According to a non-limiting embodiment, a rigidity of the the coupling structure 8*a* can be the same as a rigidity of the flexible support structure 8 that holds the rigid element 202. According to a preferred, non-limiting embodiment, the flexible coupling structure 8***a* has a thickness in the range of 0.1-1 mm. Also, according to a preferred, non-limiting embodiment, the flexible coupling structure 8*a* has a rectangular or square shape (viewed in a top view).

The coupling structure 8*a* can be made in one-piece with a front side of the rigid element 202, or it can be a separate component that is integrally fixed to the rigid element 202.

For example, the coupling structure 8*a*, that is provided with the actuator 206, extends substantially in parallel with a front side F of the rigid element 202, substantially in the same plane as that front side F (perpendicular with respect to said X-direction).

For example (see FIG. 9), the sound generator can include a single rigid element 202 (the element 202 enclosing a plurality of air compartments 3, and having a back side B comprising apertures 4, and a front side F that is closed), wherein the rigid element 202 includes an aperture 250 (for example a central aperture) that is closed by said coupling structure 8*a* (that carries the piezoelectric actuator 206) along a front side. Alternatively, the sound generator can comprise a plurality of rigid elements 202. Particularly, said aperture 250 is not provide with the above-mentioned air-compartments 3; the aperture 250 is laterally surrounded by opposite sides of the rigid element 202 (viewed in lateral Y-directions), and is part of the internal air space S.

In the FIG. 9 embodiment, the piezoelectric actuator 206 extends in the interior air space S; the actuator 206 is mounted onto an inner surface of the coupling plate 8*a*.

Figure 10:
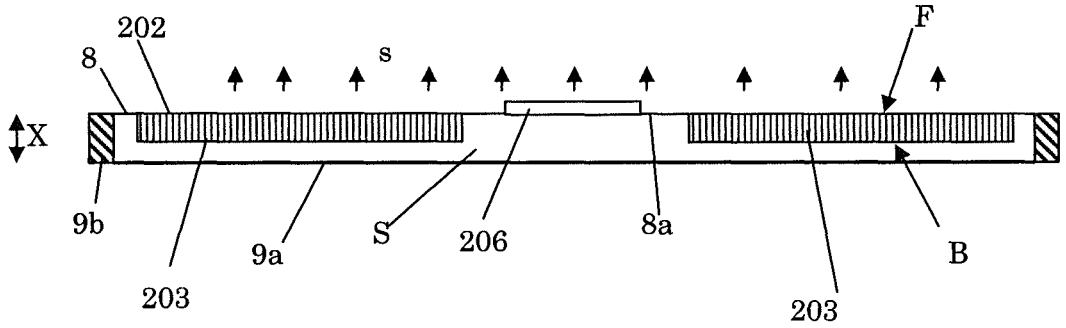

FIG. 10 shows an alternative embodiment, which differs from the FIG. 9 embodiment in that the piezoelectric actuator 206 extends externally with respect to the interior air space S; the actuator 206 is mounted onto the outer surface of the coupling plate 8*a*.

Figure 11:
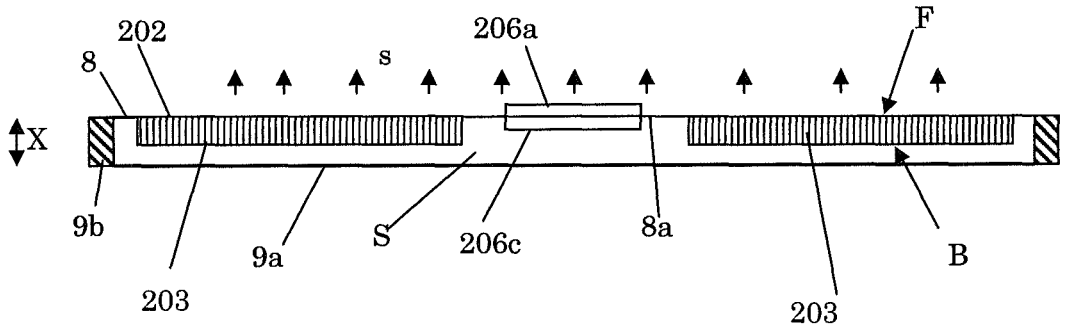

FIG. 11 shows an alternative embodiment, which differs from the FIG. 9-10 embodiments in that a first the piezoelectric actuator 206*a* extends externally with respect to the interior air space S, and a second piezoelectric actuator 206*c* extends in the interior air space S.

Figure 12:
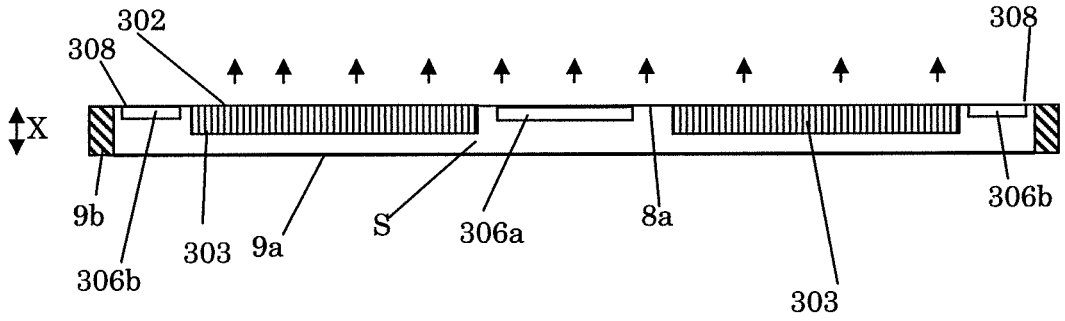
Figure 13:
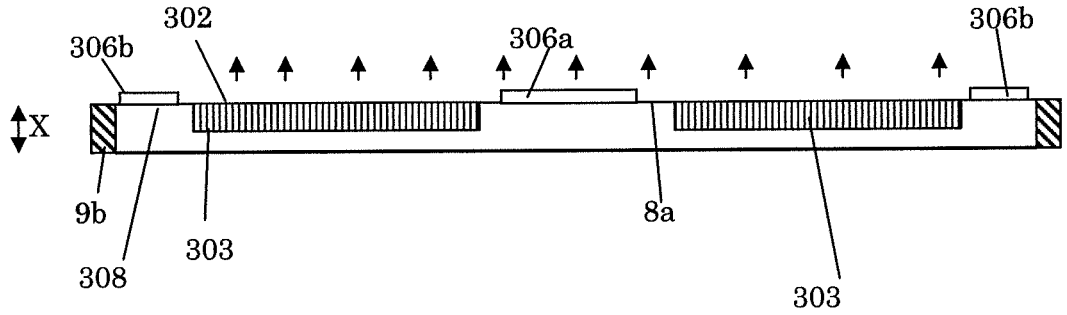
Figure 14:
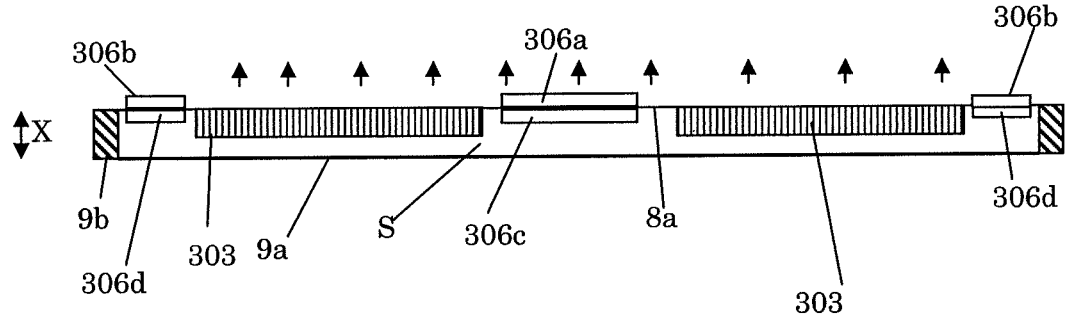

FIGS. 12-14 show further embodiments, which are similar to the embodiments of FIGS. 9-11, respectively. In the embodiments of FIGS. 12-14, further piezoelectric actuators 306*b*, 306*d* are provided at the flexible support structure 8 that holds the rigid element 302, to actuate that element 302.

The FIG. 12 embodiment differs from the FIG. 9 embodiment in that further piezoelectric actuators 306*b* extends in the interior air space S; these actuator 306*b* are mounted onto an inner surface of the (flexible) support 308 (or supports 308) that connects (or connect) the rigid element(s) 303 to the rigid side wall 9*b*. Also, an actuator 306*a* is provided, at the (central) part 8*a*.

The FIG. 13 embodiment differs from the FIG. 10 embodiment in that further piezoelectric actuators 306*b* extends externally with respect to the interior air space S; these actuator 306*b* are mounted onto an external surface of the (flexible) support 308 (or supports 308).

The FIG. 14 embodiment is a combination of the embodiments of FIGS. 12-13, and comprises piezoelectric actuators 306*a*, 306*b* extending externally with respect to the the interior air space S, as well as piezoelectric actuators 306*c*, 306*d* extending internally in the device (on opposite sides of respective support parts 308, 8*a*.

Figure 15:
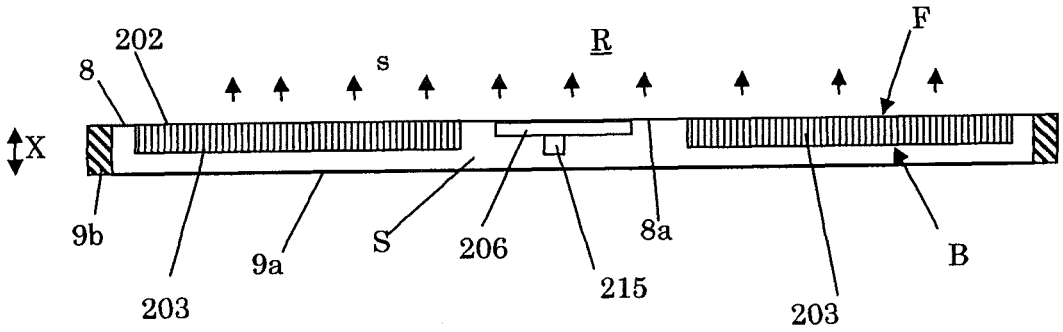

The embodiment of FIG. 15 is similar to the FIG. 9 embodiment, and also comprises with a detector 215. For example, the detector can be configured to detect a position or orientation of the piezoelectric actuator.

The detector 215 can be configured in various ways, and may include one or more of: optical detectors, strain sensors, electrical sensors, alignment detectors, acceleration detectors, positioning means, acoustic sensors and/or other sensor types.

For example, the detector 215 can be mounted on the piezoelectric actuator 206, as in FIG. 15. For example, the detector 215 can extend or reach in/into the interior air space S. Alternatively, the detector 215 can be integrated with the actuator 206. Alternatively, the detector 215 can be spaced-apart from the actuator 206.

According to an embodiment, the detector 215 can be configured to provide a signal, which signal can be used for correcting a frequency response of the sound generator and/or for improvement of a position and/or orientation of the vibrating structure (the structure including for example the rigid element(s) 202).

Alternatively, an afore-mentioned piezoelectric actuator 206, 206*a*, 206*c*, 306*a*, 306*b*, 306*c*, 306*d* can be According to an embodiment, the detector 215 can be configured to provide a signal, which signal can be used for correcting a frequency response of the sound generator and/or for improvement of a position and/or orientation.

Although the illustrative embodiments of the present invention have been described in greater detail with reference to the accompanying drawings, it will be understood that the invention is not limited to those embodiments. Various changes or modifications may be effected by one skilled in the art without departing from the scope or the spirit of the invention as defined in the claims.

It is to be understood that in the present application, the term "comprising" does not exclude other elements or steps. Also, each of the terms "a" and "an" does not exclude a plurality. Also, a single processor or other unit may fulfil functions of several means recited in the claims. Any reference sign(s) in the claims shall not be construed as limiting the scope of the claims.

The invention claimed is:

1. A sound generator configured to emit sound, comprising:

a rigid element enclosing a plurality of air compartments, the rigid element comprising:
a back side comprising apertures, and
a front side that is closed, an air space, within the sound generator, separated from the plurality of air compartments by the back side of the rigid element and external to the rigid element;

a rigid housing comprising a rigid back part that extends opposite the back side of the rigid element;

a support structure configured to flexibly hold the rigid element in relation to the rigid housing; and an actuator configured to drive the rigid element to perform a piston type of movement, in a transverse direction with respect to the back side and front side surfaces of the rigid element, during operation to generate sound;

wherein the actuator comprises:
a first part fixed to the rigid element, and
a second part fixed to the rigid housing,
wherein the first part and the second part are configured to move relative to one another, wherein the air space is located between the rigid back part of the rigid housing and the back side of the rigid element so that the rigid housing and the rigid element are spaced-apart, wherein the rigid element is movable in relation to the rigid back part of the rigid housing by flexing the support structure during operation of the actuator, wherein the apertures are in air connection with the air space along the back side of the rigid element, and wherein the support structure provides a seal around a perimeter of the rigid element.

2. The sound generator according to claim 1, wherein the air space occupies a volume that is smaller than an overall internal volume of the rigid element.

3. The sound generator according to claim 1, wherein the apertures are arranged to provide air connections to the plurality of air compartments of the rigid element.

4. The sound generator according to claim 1, wherein a front face of the rigid back part and the back side of the rigid element extend in parallel with one another.

5. The sound generator according to claim 1, wherein the at least one actuator at least partly extends in the rigid element.

6. The sound generator according to claim 1, wherein the rigid element has a sandwich structure.

7. The sound generator according to claim 1, wherein the rigid element has a honeycomb cell structure.

8. The sound generator according to claim 1, wherein a thickness of each air compartment of the rigid element, measured from the front side to the back side, is larger than approximately 1 mm.

9. The sound generator according to claim 8, wherein the thickness of each air compartment of the rigid element, measured from the front side to the back side, is larger than 1 cm.

10. The sound generator of claim 8 wherein the thickness of each air compartment is in a range of about 1-50 mm.

11. The sound generator according to claim 1, wherein the front and back side of the rigid element are substantially parallel.

12. The sound generator according to claim 1, wherein the rigid element is substantially flat and has a thickness that is significantly smaller than longitudinal dimensions of the element.

13. The sound generator according claim 1, further comprising one or more detectors to detect a position or orientation of the rigid element.

14. The sound generator of claim 13 wherein the detectors are used with actuators to counteract undesired displacements or misalignments of the rigid element.

15. The sound generator according to claim 1, further comprising one or more frequency response adjusters to adjust frequency response characteristics of the rigid element.

16. The sound generator according to claim 1, wherein the sound generator is provided with at least one piezoelectric element configured to actuate the rigid element for the generation of the sound, wherein the actuator is coupled to the rigid element via a respective flexible coupling structure, wherein the rigid element includes an aperture that is closed by said coupling structure.

17. The sound generator of claim 1 wherein the sound generator is a loudspeaker.

18. The sound generator of claim 1 wherein the at least one actuator comprises one or more electromagnetic actuators.

19. The sound generator of claim 1 wherein the at least one actuator comprises one or more piezoelectric elements.

20. The sound generator according to claim 1, wherein the back side of the rigid element comprises a perforated back plate integrally connected to a cell structure providing the plurality of compartments, the perforated back plate providing rigidity of the rigid element.

21. The sound generator according to claim 1, wherein the support structure provides an air-tight seal between the rigid element and the rigid housing.

22. A sound generator configured to emit sound, comprising:

a rigid element enclosing a plurality of air compartments, the rigid element comprising:

a back side comprising apertures, and a front side that is closed, an air space, within the sound generator, separated from the plurality of air compartments by the back side of the rigid element and external to the rigid element;

a rigid housing comprising a rigid back part that extends opposite the back side of the rigid element;

a support structure configured to flexibly hold the rigid element in relation to the rigid housing; and an actuator configured to drive the rigid element to perform a piston type of movement, in a transverse direction with respect to the back side and front side surfaces of the rigid element, during operation to generate sound;

wherein the actuator comprises:

a first part fixed to the rigid element, and a second part fixed to the rigid housing, wherein the first part and the second part are configured to move relative to one another, wherein the air space is located between the rigid back part of the rigid housing and the back side of the rigid element so that the rigid housing and the rigid element are spaced-apart, wherein the rigid element is movable in relation to the rigid back part of the rigid housing by flexing the support structure during operation of the actuator, wherein the apertures are in air connection with the air space along the back side of the rigid element, and wherein the rigid housing comprises:

a rigid planar back part extending parallel to a planer surface of the rigid element; and a sidewall protruding from a planar surface of the rigid planar back part, wherein the support member couples the sidewall to an edge of the rigid element.

23. The sound generator according to claim 22, wherein a front face of the rigid back part and the back side of the rigid element extend in parallel with one another.

24. The sound generator according to claim 22, wherein the back side of the rigid element comprises a perforated back plate integrally connected to a cell structure providing the plurality of compartments, the perforated back plate providing rigidity of the rigid element.

* * * * *